United States Patent [19]

Wagle

[11] 4,442,326

[45] Apr. 10, 1984

[54] DRIVE MEANS FOR A TIMING MECHANISM

[75] Inventor: William F. Wagle, Bloomington, Ind.

[73] Assignee: Emhart Industries, Inc., Indianapolis, Ind.

[21] Appl. No.: 398,403

[22] Filed: Jul. 14, 1982

Related U.S. Application Data

[63] Continuation-in-part of Ser. No. 205,012, Nov. 7, 1980, abandoned.

[51] Int. Cl.[3] ..... H01H 43/10

[52] U.S. Cl. ..... 200/38 R; 200/38 C

[58] Field of Search ..... 200/35 R, 38 R, 38 FA, 200/38 B, 38 BA, 38 C, 38 CA, 153 LB

[56] References Cited

U.S. PATENT DOCUMENTS 2,803,715 8/1957 Guth ..... 200/38 C 3,015,003 12/1961 Simmons ..... 200/38 B 3,331,929 7/1967 Holtkamp ..... 200/38 C X 4,060,702 11/1977 Linn ..... 200/38 C X

*Primary Examiner*—J. R. Scott

*Attorney, Agent, or Firm*—Robert F. Meyer

[57] ABSTRACT

Rotation of a cam means of a timing mechanism is provided by three sets of axially aligned ratchet teeth having different major and minor diameters and a drive pawl selectively engaging the three sets of teeth.

The arrangement provides a means to delay the actuation of switches which control the functions of an appliance.

In one embodiment, the relationship between the three sets of ratchet teeth allows a variable range of interval times in a single timer program. That is, the arrangement provides variable dwell times versus cam advance times.

4 Claims, 9 Drawing Figures

DRIVE MEANS FOR A TIMING MECHANISM

BACKGROUND OF THE INVENTION

This application is a continuation-in-part of application Ser. No. 06/205,012 "Drive Means For Timing Mechanism" filed Nov. 7, 1980 now abandoned.

Generally speaking, the present invention pertains to a drive means of a timing mechanism which comprises first ratchet teeth of a first major diameter coupled to a cam means; second ratchet teeth of a second major diameter in working relationship with the first ratchet teeth; third ratchet teeth of a third major diameter in working relation with the first and second ratchet teeth; and a drive pawl selectively engaging two of the first, second and third ratchet teeth at a first predetermined period of time to intermittently rotate the same, and a single one of said first, second and third ratchet teeth to intermittently rotate same.

The present invention relates to a timing mechanism and, more particularly, to a timing mechanism having a means to delay the operational program of the timing mechanism and to provide variable interval time periods so as to provide variable dwell (delay) times versus cam advance times.

Timing mechanisms have been used in the appliance industry for many years to control the sequential operation of an appliance such as a washer, dryer, dishwasher and of recent years, microwave ovens. In such applications, it has sometimes been found necessary to apply electrical power to the timing mechanism while at the same time delay the initiation of the program provided by the timing mechanism until a desired starting time. In addition, depending on the desired programs, it is also highly desirable to provide variable interval or delay times between advance times. For the most part, the mechanisms used to provide such delay have been complicated, difficult to fabricate, and costly to produce.

FEATURES OR OBJECTS OF THE INVENTION

It is, therefore, a feature of the present invention to provide a timing mechanism having a means to delay initiation of the program provided by the timing mechanism. Another feature of the invention is to provide a means to provide variable interval or delay times between advance times. Another feature of the invention is to provide a timing mechanism wherein such means is simple and easy to produce. Another feature of the invention is to provide such a timing mechanism which utilizes cooperating sets of ratchet teeth of different major diameters. Still another feature of the invention is to provide such a timing mechanism wherein a single drive pawl selectively engages two of the three sets of ratchet teeth during a first predetermined period of time and a single one of the first, second and third ratchet teeth during a second predetermined period of time. These and other features of the invention will become apparent from the following description taken in conjunction with the accompanying drawings.

DETAILED DESCRIPTION OF THE DRAWINGS

Figure 1:
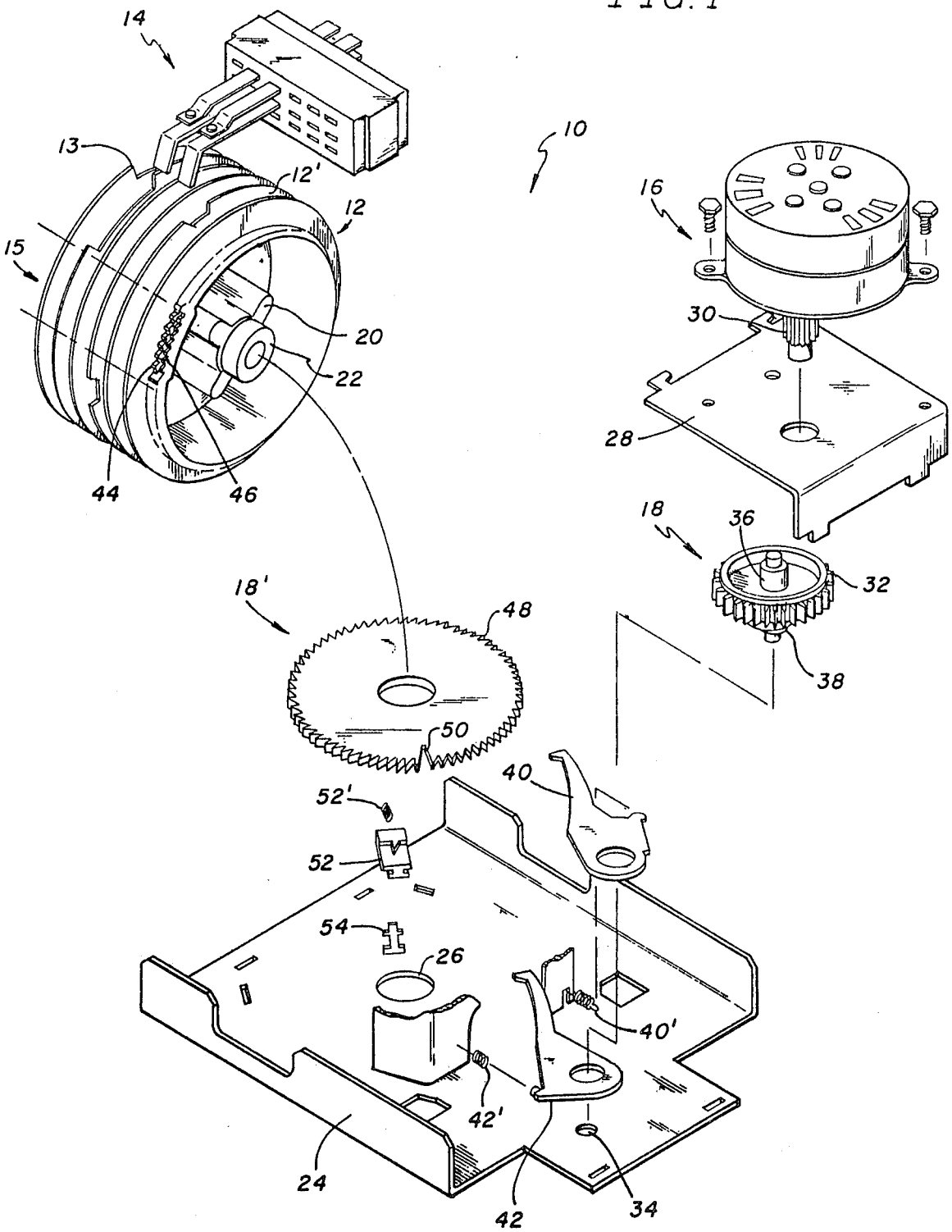
FIG. 1 is an exploded view of a timing mechanism employing the features of the invention.

Referring now to FIG. 1, there is shown a timing mechanism 10 which, in general, includes a cam means 12 which upon rotation selectively opens and closes electrical switch means 14 that engages the cam means, and a motor drive means 16 which applies power driven rotation to the cam means 12 through drive means 18. Cam means 12 includes a plurality of cams 12' having coded indicia 13 thereon and that are integrally formed on a hub portion 20 and a shaft 22, shaft 22 being rotatably journalled in base plate 24 through aperture 26. Motor drive means 16 is carried on a plate 28 which is secured to base plate 24. Motor drive means 16 may be of any suitable type known in the industry such as a synchronous motor.

Drive means 18 includes a motor output pinion 30 which extends through plate 28 and engages a drive gear 32, the drive gear 32 having a major axis defined by hub and shaft 36 which is rotatably journalled in base plate 24 through aperture 34. Gear 32 also includes an eccentric 38 which is slightly off center of the major axis. A drive pawl 40 and a stop pawl or a secondary drive pawl 42 are carried by eccentric 38 to be rotated in accordance with the movement of the eccentric. The portion of the drive means 18 described thus far, as well as the other elements of the timing mechanism previously described, are well known in the art and form no part of the present invention.

Figure 2:
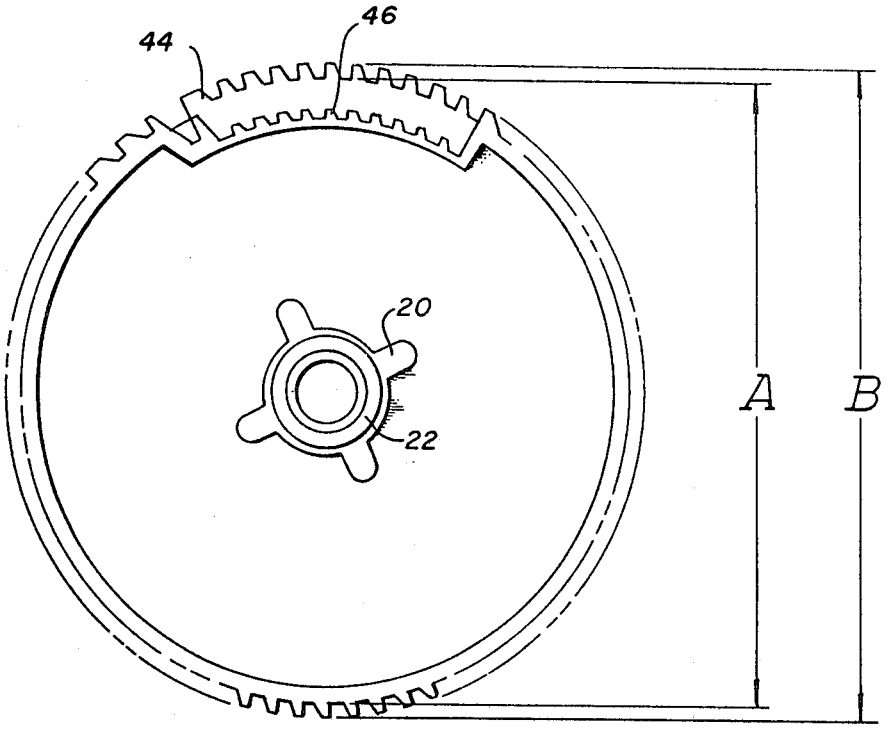
FIG. 2 is a view of a typical ratchet illustrating major and minor diameters.

The present invention is concerned with the drive portion 18' of drive means 18 which provides a means to delay the operation of electrical switch means 14 even though electric power has been applied to the device. Drive means 18' includes first ratchet teeth 44 which are integral with cam means 12, second ratchet teeth 46 which are also integral with cam means 12, and third ratchet teeth 48 which is independently rotatably carried on shaft 22. Each of the ratchet teeth has a major and minor diameter. For the purposes of the present invention the meaning of the terms major and minor diameters are illustrated in FIG. 2. Referring to FIG. 2, a major diameter B is the distance to the outermost point of the teeth while a minor diameter A is a distance to the base of the teeth. Ratchet teeth 46 has a major diameter B which is less than the major diameter of ratchet teeth 44 and a minor diameter A which is also less than the minor diameter of teeth 44. For the sake of clarity, ratchet teeth 48 are not shown in FIG. 2, but they have a major diameter which is less than the major diameter of ratchet teeth 44 but greater than the major diameter of ratchet teeth 46. Such teeth relationship is shown with reference to FIGS. 3–5.

Returning to FIG. 1, and as will be hereinafter explained, drive pawl 40 selectively engages ratchet teeth 48 and ratchet teeth 46 during a predetermined period of time and further engages only ratchet teeth 44 during another period of time. Ratchet 48 includes a notch 50 that is of sufficient depth to provide a minor diameter at least as small as the minor diameter of ratchet teeth 46. Stop pawl or secondary drive pawl 42 engages ratchet teeth 44 to prevent backlash of cam means 12 during its intermittent rotation while slider 52, which is slidably carried in slot 54 of base member 24, engages ratchet teeth 48 to prevent its backlash. Pawls 40 and 42 are spring biased through coil springs 40' and 42' to insure engagement of the pawls with ratchet teeth 44 while slider 52 is spring biased through spring 52' (which engages another frame member of the timing mechanism, not shown) to insure engagement of the slider with ratchet teeth 48 all in a manner well known in the art.

The number of teeth of ratchet teeth 46 corresponds to the amount of delay time desired. For example, each tooth could represent an hour. The location of the teeth and cam means 12 with respect to a zero start time as to the number of delay hours desired can then be manually set by manually rotating an extension of shaft 22 (not shown) through a clutch in a manner well known in the art.

Figure 3:
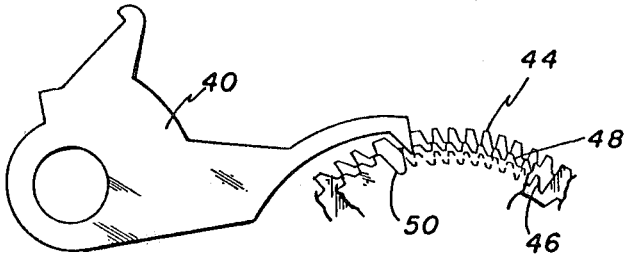
FIGS. 3–5 are similar views illustrating three modes of operation of the drive means of the present invention.

The operation of drive means 18' can now be described with reference to FIGS. 3–5, it being understood that drive pawl 40 and stop pawl 42 are operated through motor drive means 16 and eccentric 38. In FIG. 3, drive pawl 40 is engaging the teeth of ratchet 48 only to drive it alone. Both ratchets 46 and 44 are stationary.

Figure 4:
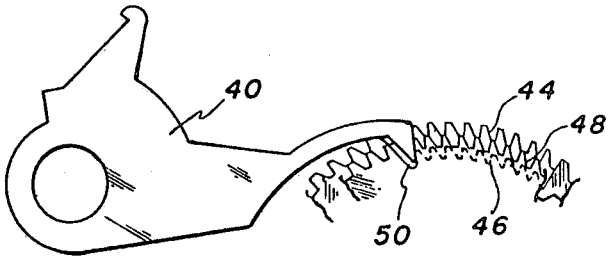

In FIG. 4, drive pawl 40 has engaged slot 50 of ratchet 48. Since, as noted previously, the depth of knotch 50 is of sufficient depth to provide a minor diameter at least as small as the minor diameter of ratchet 46, drive pawl 40 will also engage ratchet 46. Since, in the present embodiment, both ratchet teeth 44 and 46 are integral with cam means 12, the cam means will advance one step in accordance with the teeth of ratchet teeth 46. However, it should be understood that during this time, cam means 12 will not be in a position to activate any of the switches of electrical switch means 14. More specifically, and as previously noted, the number of teeth in ratchet teeth 46 corresponds to the delay time. Therefore, a portion 15 (FIG. 1) of the perimeter of cam means 12 that is in line with and approximtely equal to the arc length of ratchet teeth 46 will be free of coded indicia 13 which control functions of the appliance so that corresponding switches of switch means 14 cannot be activated.

Figure 5:
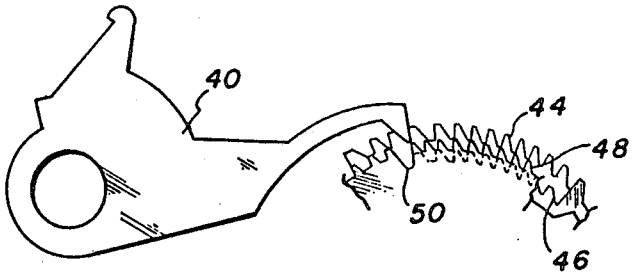

In FIG. 5, drive pawl 40 has passed through ratchet teeth 46 and now engages ratchet teeth 44 for continued intermittent rotation of cam means 12 to start the normal program of the timing mechanism and activate electrical switch means 14.

Referring now to FIGS. 6 and 7A through 7C, another embodiment of the invention can now be described. This embodiment allows a variable range of time intervals in a single given timer program. Prior art interval timers have fixed interval periods throughout their respective cycles. The variable range of time intervals is accomplished primarily by providing ratchet teeth 44', 46' and 48' in place of the previously described ratchets 44, 46 and 48. As in the case of the embodiment of FIGS. 1–5, ratchet teeth 44' and 46' are integral with cam means 12, while ratchet teeth 48' are independently rotatably carried on shaft 22.

Ratchet teeth 44' are the same as those of ratchet teeth 44 of the embodiment of FIGS. 1–5. Ratchet teeth 46' have a major diameter E which is less than the major diameter F of ratchet teeth 44' while teeth 102 have the same major diameter as teeth 44' and are integral therewith.

Ratchet teeth 48' has a major diameter which is the same as major diameter F of teeth 102 and 44'. As shown, there is a plurality of notches 50' which have a minor diameter G which is at least as small as a minor diameter of ratchet 46'.

It is to be understood that the number of teeth in any one ratchet and the spacing between the teeth is dependent upon the particular program including the amount of interval time desired.

Figure 7A:
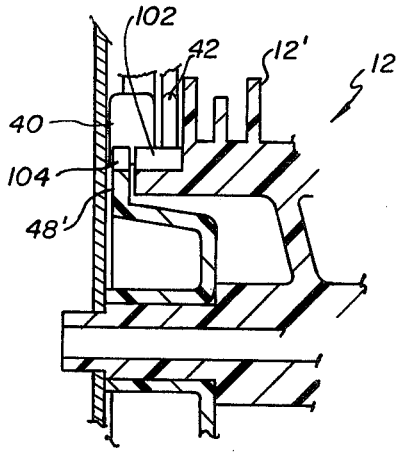
FIGS. 7A through 7C are plan views showing the relationship between the alternate ratchet teeth and the drive pawls of the timing mechanism.
Figure 7B:
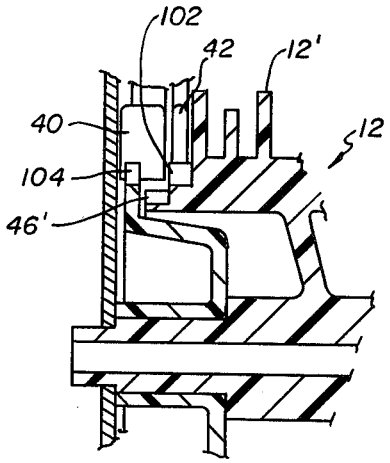
Figure 7C:
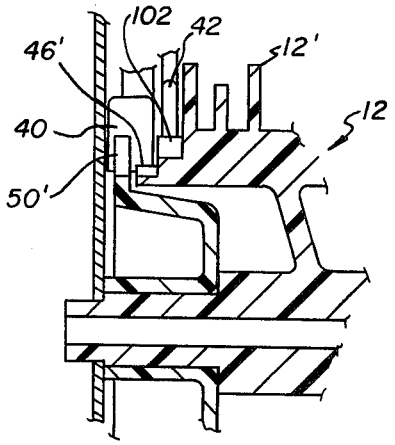

Referring now to FIGS. 7A–7C, the operation of the present embodiment may be described. In FIG. 7A, main drive pawl 40 is in engagement with both ratchet teeth 102 and 104 while secondary drive pawl 42 engages teeth 102. Thus both cam means 12 and ratchet teeth 48' are incremently moved. In FIG. 7B main drive pawl 40 is engaging ratchet teeth 104 only while secondary drive pawl 42 engages teeth 102. In this mode, cam means 12 is substantially stationary since there is only a slight movement of secondary drive pawl 42. In FIG. 7C drive pawl 40 has engaged one of the notches 50' of ratchet 48' to engage teeth 46' while secondary drive pawl 42 continues to engage teeth 102. In this mode, cam means 12 advances for one interval of notch 50'.

Figure 6:
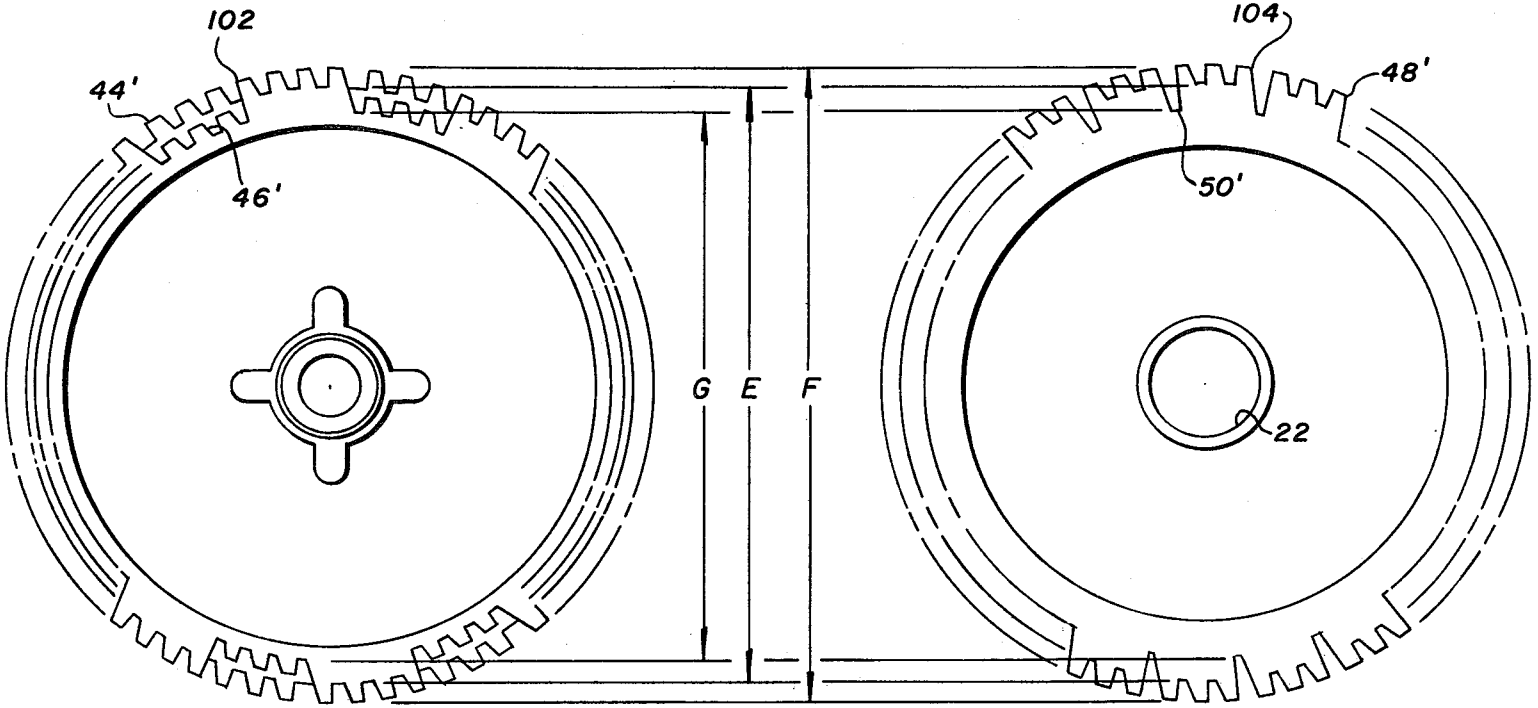
FIG. 6 is a view of alternate ratchet teeth.

There is thus provided in the embodiment of FIGS. 6 through 7C a means of varying the time between advances of cam means 12, the time intervals being programmed by selection of the spacing of notches 50', major diameter ratchet teeth spacing and intervals between the strokes of pawls 40 and 42.

What is claimed is:

1. A timing mechanism comprising (a) a cam means rotatably carried on a shaft and providing a program and electrical switches opening and closing in response to said program, (b) rotatable first ratchet teeth of a first major diameter carried on said shaft and coupled to said cam means for intermittent rotation therewith, (c) groups of rotatable second ratchet teeth coupled to and in axial alignment with said first rotatable ratchet teeth and of a second major diameter which is less than said first major diameter, (d) rotatable third ratchet teeth carried by said shaft in axial alignment with said first and second ratchet teeth and independently rotatable from said first and second ratchet teeth and having a third major diameter which is greater than said second major diameter and further having a plurality of notches of sufficient depth to provide a minor diameter at least as small as a minor diameter of said second ratchet teeth, (e) a drive pawl selectively engaging said first and third rotatable ratchet teeth and said second ratchet teeth when engaged with said notches, and (f) individual stop means engaging said first and third ratchet teeth.

2. A timing mechanism according to claim 1 wherein said group of rotatable second ratchet teeth are separated by teeth integral with and of the same major diameter as said first ratchet teeth.

3. A method of delaying actuation of electrical switches which control functions of an appliance and that are responsive to a rotation of a cam means comprising:

(a) providing first ratchet teeth of a first major diameter coupled to said cam means, (b) providing groups of second ratchet teeth of a second lesser major diameter than said first major diameter in working relation to said first ratchet teeth, the number of teeth being proportional to a desired time of said delayed actuation, (c) providing a third set of ratchet teeth of a third major diameter that is greater than said second major diameter and further including a plurality of notches having a minor diameter which is at least less than a minor diameter of said second ratchet teeth, and (d) providing a drive means driving said cam means and including a drive pawl selectively engaging said first and third ratchet teeth and said second ratchet teeth when engaged with said notches.

4. A timing mechanism according to claim 3 wherein said groups of second ratchet teeth are separated by teeth integral with and of the same major diameter as said first ratchet teeth.

* * * * *

UNITED STATES PATENT AND TRADEMARK OFFICE

CERTIFICATE OF CORRECTION

PATENT NO. : 4,442,326
DATED : April 10, 1984

INVENTOR(S) : William E. Wagle

It is certified that error appears in the above—identified patent and that said Letters Patent is hereby corrected as shown below:

In the inventor's name delete "F" and insert---E---.

Signed and Sealed this

*Fifth* Day of *March 1985*

[SEAL]

*Attest:*

DONALD J. QUIGG

*Attesting Officer* *Acting Commissioner of Patents and Trademarks*